US010979845B1

(12) United States Patent
Lovitt et al.

(10) Patent No.: US 10,979,845 B1
(45) **Date of Patent: *Apr. 13, 2021**

(54) AUDIO AUGMENTATION USING ENVIRONMENTAL DATA

(71) Applicant: Facebook Technologies, LLC, Menlo Park, CA (US)

(72) Inventors: Andrew Lovitt, Redmond, WA (US); Scott Phillip Selfon, Kirkland, WA (US); Antonio John Miller, Woodinville, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/783,192

(22) Filed: Feb. 6, 2020

Related U.S. Application Data

(63) Continuation of application No. 16/208,596, filed on Dec. 4, 2018, now Pat. No. 10,595,149.

(51) Int. Cl.
*H04S 7/00* (2006.01)
*H04S 3/00* (2006.01)
*G10K 11/178* (2006.01)

(52) U.S. Cl.
CPC ..... *H04S 7/304* (2013.01); *G10K 11/17823* (2018.01); *H04S 3/008* (2013.01); *G10K 2210/1081* (2013.01); *H04S 2400/01* (2013.01); *H04S 2400/11* (2013.01)

(58) Field of Classification Search
CPC ... H04S 7/30; H04S 7/40; H04S 7/302; H04S 7/303; H04S 7/304; H04S 3/008; H04S 2400/01; H04S 2400/11; H04S 2420/01; H04R 3/00; H04R 3/005; G10K 11/17823; H04N 7/181; H04N 7/183
See application file for complete search history.

(56) References Cited

U.S. PATENT DOCUMENTS 9,076,450 B1 7/2015 Sadek et al.
10,595,149 B1 * 3/2020 Lovitt ..... H04S 3/008
2012/0093320 A1 4/2012 Flaks et al.
(Continued)

FOREIGN PATENT DOCUMENTS

WO 2020/117283 A1 6/2020

OTHER PUBLICATIONS

Preinterview First Office Action received for U.S. Appl. No. 16/208,596 dated Sep. 23, 2019, 7 pages.
(Continued)

*Primary Examiner* — Thang V Tran
(74) *Attorney, Agent, or Firm* — FisherBroyles, LLP

(57) ABSTRACT

The disclosed computer-implemented method for performing directional beamforming according to an anticipated position may include accessing environment data indicating a sound source within an environment. The device may include various audio hardware components configured to generate steerable audio beams. The method may also include identifying the location of the sound source within the environment based on the accessed environment data, and then steering the audio beams of the device to the identified location of the sound source within the environment. Various other methods, systems, and computer-readable media are also disclosed.

20 Claims, 8 Drawing Sheets

(56) References Cited

U.S. PATENT DOCUMENTS

| | | | |
|---|---|---|---|
| 2012/0213375 | A1 | 8/2012 | Mahabub et al. |
| 2017/0230760 | A1 | 8/2017 | Sanger et al. |
| 2018/0176680 | A1 | 6/2018 | Knight et al. |
| 2018/0203112 | A1 | 7/2018 | Mannion et al. |

OTHER PUBLICATIONS

Notice of Allowance received for U.S. Appl. No. 16/208,596 dated Nov. 6, 2019, 39 pages.
International Search Report and Written Opinion received for PCT Application Serial No. PCT/US2018/066942 dated Sep. 3, 2019, 8 pages.

* cited by examiner

AUDIO AUGMENTATION USING ENVIRONMENTAL DATA

CROSS REFERENCE TO RELATED APPLICATIONS

This application is a continuation of U.S. patent application Ser. No. 16/208,596, filed 4 Dec. 2018, the disclosure of which is incorporated, in its entirety, by this reference.

BACKGROUND

Augmented reality (AR) and virtual reality (VR) devices are becoming increasingly common. AR devices typically have two main components including a display and a sound source, while VR devices typically include a display, a sound source and haptics components that provide haptic feedback to the user. The display may be a full headset in the case of VR, or may be a pair of glasses in the case of AR. The sound source may include speakers built into the AR/VR device itself or may include separate earphones.

Current speakers in such AR and VR systems are typically designed to reproduce audio for the user without a great deal of customization. In some cases, the audio may be processed using surround sound decoding. And, in such cases, the output audio may be spatialized to sound like it is coming from a certain direction (e.g., in front of, to the side of or behind the user). However, the audio processing does not take into account whether the AR/VR device itself is moving, or where the device is moving, or whether other AR/VR devices are present in the immediate area.

SUMMARY

As will be described in greater detail below, this disclosure describes methods and systems that access environment data indicating the location of a sound source within the environment and then beamform in that direction in order to improve audio reception. In one example, a computer-implemented method for performing directional beamforming based on environment data may include accessing, at a device, environment data that includes an indication of at least one sound source within the environment. The process of "beamforming" or targeting an audio beam at a given person or location may increase a playback headset's ability to provide a clear and intelligible audio signal to the user. The audio beam may be a focused region to which a microphone is directed in order to capture audio signals. The device may include audio hardware components that are configured to generate such steerable audio beams. The method may also include identifying the location of the sound source within the environment based on the accessed environment data, and then steering the audio beams of the device to the identified location of the sound source within the environment.

In some examples, the device may be an augmented reality (AR) or virtual reality (VR) device. The environment may include multiple AR or VR devices, where each AR or VR device records its own location. In some examples, the environment may include multiple AR devices, where each AR device may record the location of other AR devices using sensor data captured by the AR devices. In some examples, the AR device may track the location of multiple other AR devices using the environment data.

In some examples, historical device movement data may be implemented to identify a future sound source location where the sound source (e.g., a person) is likely to move.

Future sound source locations may be determined on a continually updated basis. In this manner, the audio beams of the device may be continually steered to the updated future sound source location.

In some examples, the method for directionally beamforming based on an anticipated location may include detecting that a reverberated signal was received at a device at a higher signal level than a direct-path signal. The method may further include identifying a potential path traveled by the reverberated signal, and then steering the audio beams to travel along the identified path traveled by the reverberated signal. The method may also include transitioning the audio beam steering back to a direct path as the device moves between the current device location and the future sound source location.

In some examples, the audio beams may be steered based on a specific beamforming policy. Some embodiments may include accessing an audio signal that is to be reproduced using the audio beams, identifying the location of another device, and modifying the accessed audio signal to spatially re-render the audio signal to sound as if coming from the other device.

In some examples, the device may receive pre-generated environment data or historical environmental data from a remote source and may implement the received environment data or historical environmental data to identify the future sound source location. In some examples, other devices in the environment may provide environment data to a server or to another local or remote device. The server may augment the environment information to account for delay and constraints of a target device.

In some examples, steering control signals are generated upon determining that beamforming is needed to raise a signal level to a specified minimum level. In some examples, the accessed portions of environment data may be used to perform selective active noise cancellation in a specified direction. In some examples, various active noise cancellation parameters may be adjusted to selectively remove sounds from a specified a direction, or to selectively allow sounds from a specified direction. In further examples, a dry audio signal may be combined with various effects so that the modified dry audio signal sounds as if the modified dry audio signal originated in the user's current environment.

In addition, a corresponding device for directionally beamforming based on environment data may include several modules stored in memory, including a data accessing module configured to access environment data that includes an indication of a sound source within the environment. The device may include audio hardware components configured to generate steerable audio beams. The device may further include a location identifying module configured to identify the location of the sound source within the environment based on the accessed environment data. The device may also include a beam steering module configured to steer the audio beams of the device to the identified location of the sound source within the environment.

In some examples, the above-described method may be encoded as computer-readable instructions on a computer-readable medium. For example, a computer-readable medium may include one or more computer-executable instructions that, when executed by at least one processor of a computing device, may cause the computing device to access environment data that includes an indication of a sound source within the environment, identify the location of the sound source within the environment based on the accessed environment data, and steer the audio beams of the device to the identified location of the sound source within the environment.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
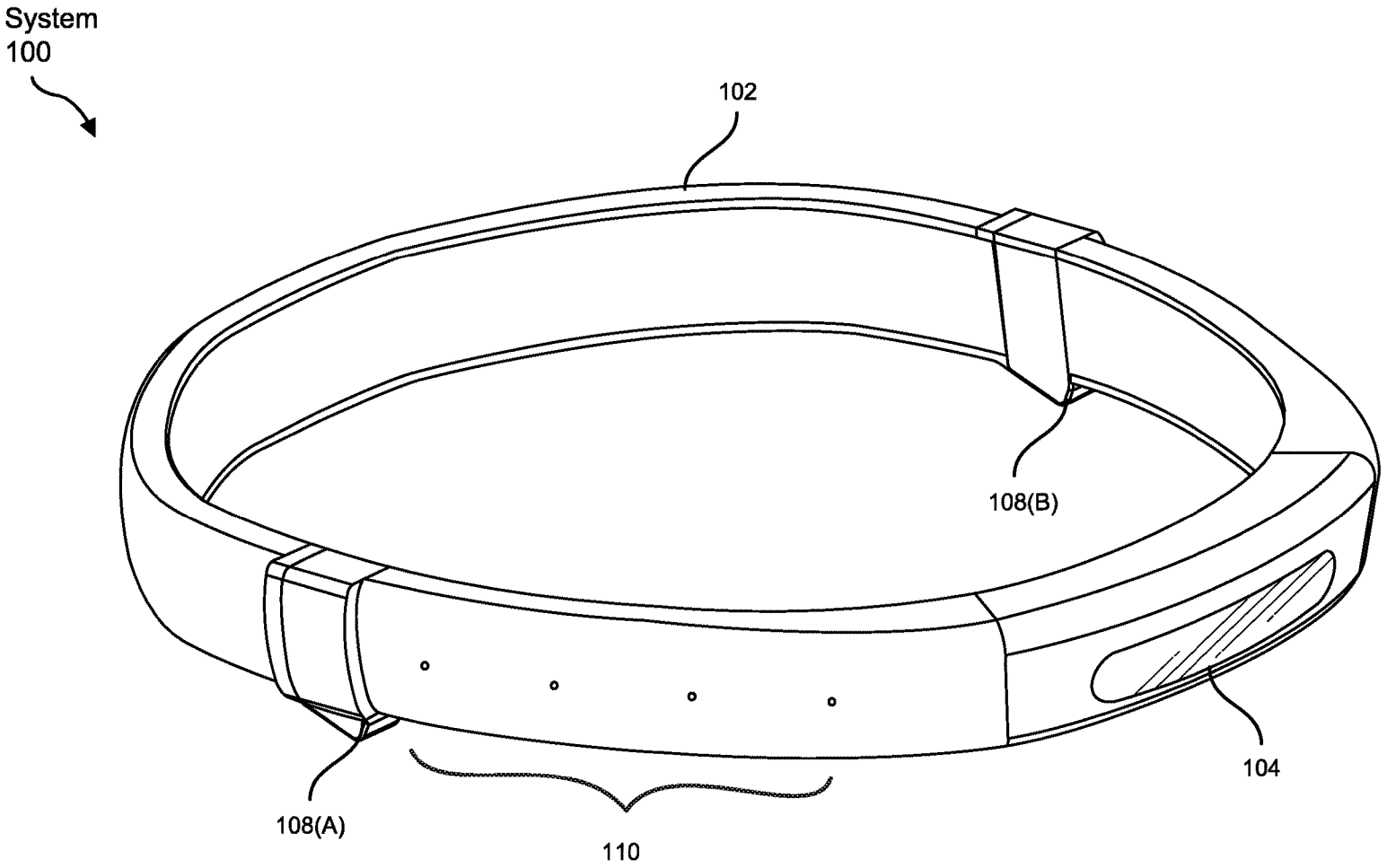
FIG. 1 illustrates an embodiment of an artificial reality headset.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The present disclosure is generally directed to methods and systems for performing directional beamforming based on environment data indicating a sound source that may be of interest to a listening user. As will be explained in greater detail below, embodiments of the instant disclosure may allow a user to more easily hear other users when using an artificial reality (AR) headset. For example, if a large number of users are in a room, or if the room has poor acoustics, users may have a hard time hearing each other. In the embodiments herein, AR headsets may be configured to perform beamforming to better focus in on a given sound source (e.g., a user who is speaking). The beamforming may not only form a beam toward a current location of a speaking user but may also direct beams to new locations in anticipation of the speaking user moving there.

Indeed, in at least some of the embodiments herein, the AR headset (or a computer system to which the AR headset is communicatively connected) may implement logic to determine where a speaking user is likely to move. The listening user's AR headset may make this determination based on knowledge of the current environment, knowledge of the speaking user's past movements, as well as current location and/or movement information for the speaking user. Using some or all of this information, the listening user's AR headset may determine where the speaking user is likely to move and, in advance of the movement, may beamform in the expected direction of movement. Then, if the speaking user moves in that direction, the listening user's AR headset will already be beamforming in that direction, thereby enhancing the listening user's ability to hear the speaking user. The process of "beamforming" or targeting an audio beam at a given person or location may increase the AR headset's ability to provide a clear and intelligible audio signal to the user.

Embodiments of the instant disclosure may include or be implemented in conjunction with various types of artificial reality systems. Artificial reality is a form of reality that has been adjusted in some manner before presentation to a user, which may include, e.g., a virtual reality (VR), an augmented reality (AR), a mixed reality (MR), a hybrid reality, or some combination and/or derivative thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., to perform activities in) an artificial reality.

Artificial reality systems may be implemented in a variety of different form factors and configurations. Some artificial reality systems may be designed to work without near-eye displays (NEDs), an example of which is AR system 100 in FIG. 1. Other artificial reality systems may include an NED that also provides visibility into the real world (e.g., AR system 200 in FIG. 2) or that visually immerses a user in an artificial reality (e.g., VR system 300 in FIG. 3). While some artificial reality devices may be self-contained systems, other artificial reality devices may communicate and/or coordinate with external devices to provide an artificial reality experience to a user. Examples of such external devices include handheld controllers, mobile devices, desktop computers, devices worn by a user, devices worn by one or more other users, and/or any other suitable external system.

Turning to FIG. 1, AR system 100 generally represents a wearable device dimensioned to fit about a body part (e.g., a head) of a user. As shown in FIG. 1, system 100 may include a frame 102 and a camera assembly 104 that is coupled to frame 102 and configured to gather information about a local environment by observing the local environment. AR system 100 may also include one or more audio devices, such as output audio transducers 108(A) and 108(B) and input audio transducers 110. Output audio transducers 108(A) and 108(B) may provide audio feedback and/or content to a user, and input audio transducers 110 may capture audio in a user's environment.

As shown, AR system 100 may not necessarily include an NED positioned in front of a user's eyes. AR systems without NEDs may take a variety of forms, such as head bands, hats, hair bands, belts, watches, wrist bands, ankle bands, rings, neckbands, necklaces, chest bands, eyewear frames, and/or any other suitable type or form of apparatus. While AR system 100 may not include an NED, AR system 100 may include other types of screens or visual feedback devices (e.g., a display screen integrated into a side of frame 102).

Figure 2:
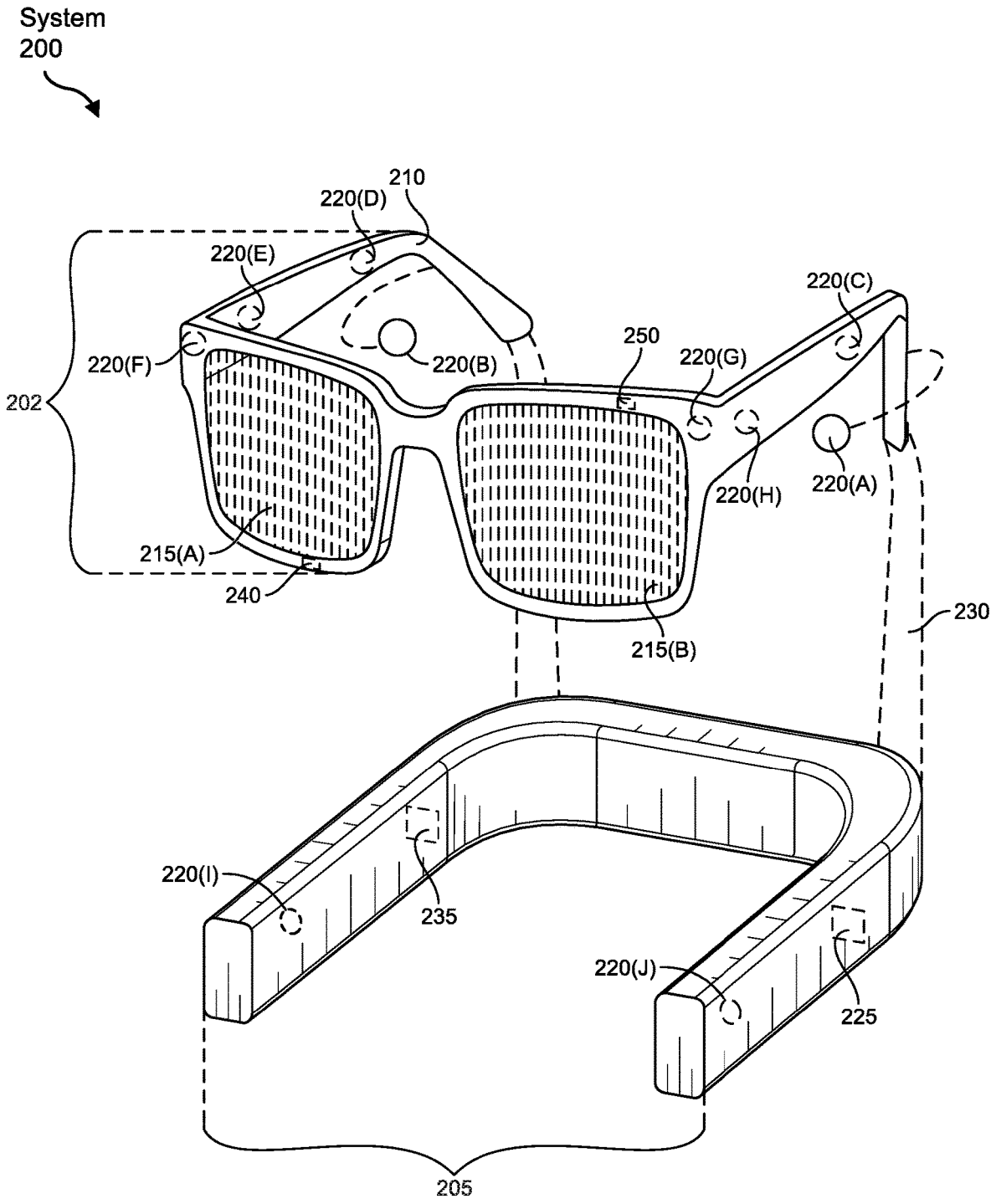
FIG. 2 illustrates an embodiment of an augmented reality headset and corresponding neckband.

The embodiments discussed in this disclosure may also be implemented in AR systems that include one or more NEDs. For example, as shown in FIG. 2, AR system 200 may include an eyewear device 202 with a frame 210 configured to hold a left display device 215(A) and a right display device 215(B) in front of a user's eyes. Display devices 215(A) and 215(B) may act together or independently to present an image or series of images to a user. While AR system 200 includes two displays, embodiments of this disclosure may be implemented in AR systems with a single NED or more than two NEDs.

In some embodiments, AR system 200 may include one or more sensors, such as sensor 240. Sensor 240 may generate measurement signals in response to motion of AR system 200 and may be located on substantially any portion of frame 210. Sensor 240 may include a position sensor, an inertial measurement unit (IMU), a depth camera assembly, or any combination thereof. In some embodiments, AR system 200 may or may not include sensor 240 or may include more than one sensor. In embodiments in which sensor 240 includes an IMU, the IMU may generate calibration data based on measurement signals from sensor 240. Examples of sensor 240 may include, without limitation, accelerometers, gyroscopes, magnetometers, other suitable types of sensors that detect motion, sensors used for error correction of the IMU, or some combination thereof.

AR system 200 may also include a microphone array with a plurality of acoustic sensors 220(A)-220(J), referred to collectively as acoustic sensors 220. Acoustic sensors 220 may be transducers that detect air pressure variations induced by sound waves. Each acoustic sensor 220 may be configured to detect sound and convert the detected sound into an electronic format (e.g., an analog or digital format). The microphone array in FIG. 2 may include, for example, ten acoustic sensors: 220(A) and 220(B), which may be designed to be placed inside a corresponding ear of the user, acoustic sensors 220(C), 220(D), 220(E), 220(F), 220(G), and 220(H), which may be positioned at various locations on frame 210, and/or acoustic sensors 220(I) and 220(J), which may be positioned on a corresponding neckband 205.

The configuration of acoustic sensors 220 of the microphone array may vary. While AR system 200 is shown in FIG. 2 as having ten acoustic sensors 220, the number of acoustic sensors 220 may be greater or less than ten. In some embodiments, using higher numbers of acoustic sensors 220 may increase the amount of audio information collected and/or the sensitivity and accuracy of the audio information. In contrast, using a lower number of acoustic sensors 220 may decrease the computing power required by the controller 250 to process the collected audio information. In addition, the position of each acoustic sensor 220 of the microphone array may vary. For example, the position of an acoustic sensor 220 may include a defined position on the user, a defined coordinate on the frame 210, an orientation associated with each acoustic sensor, or some combination thereof.

Acoustic sensors 220(A) and 220(B) may be positioned on different parts of the user's ear, such as behind the pinna or within the auricle or fossa. Or, there may be additional acoustic sensors on or surrounding the ear in addition to acoustic sensors 220 inside the ear canal. Having an acoustic sensor positioned next to an ear canal of a user may enable the microphone array to collect information on how sounds arrive at the ear canal. By positioning at least two of acoustic sensors 220 on either side of a user's head (e.g., as binaural microphones), AR device 200 may simulate binaural hearing and capture a 3D stereo sound field around about a user's head. In some embodiments, the acoustic sensors 220(A) and 220(B) may be connected to the AR system 200 via a wired connection, and in other embodiments, the acoustic sensors 220(A) and 220(B) may be connected to the AR system 200 via a wireless connection (e.g., a Bluetooth connection). In still other embodiments, the acoustic sensors 220(A) and 220(B) may not be used at all in conjunction with the AR system 200.

Acoustic sensors 220 on frame 210 may be positioned along the length of the temples, across the bridge, above or below display devices 215(A) and 215(B), or some combination thereof. Acoustic sensors 220 may be oriented such that the microphone array is able to detect sounds in a wide range of directions surrounding the user wearing the AR system 200. In some embodiments, an optimization process may be performed during manufacturing of AR system 200 to determine relative positioning of each acoustic sensor 220 in the microphone array.

AR system 200 may further include or be connected to an external device. (e.g., a paired device), such as neckband 205. As shown, neckband 205 may be coupled to eyewear device 202 via one or more connectors 230. The connectors 230 may be wired or wireless connectors and may include electrical and/or non-electrical (e.g., structural) components. In some cases, the eyewear device 202 and the neckband 205 may operate independently without any wired or wireless connection between them. While FIG. 2 illustrates the components of eyewear device 202 and neckband 205 in example locations on eyewear device 202 and neckband 205, the components may be located elsewhere and/or distributed differently on eyewear device 202 and/or neckband 205. In some embodiments, the components of the eyewear device 202 and neckband 205 may be located on one or more additional peripheral devices paired with eyewear device 202, neckband 205, or some combination thereof. Furthermore, neckband 205 generally represents any type or form of paired device. Thus, the following discussion of neckband 205 may also apply to various other paired devices, such as smart watches, smart phones, wrist bands, other wearable devices, hand-held controllers, tablet computers, laptop computers, etc.

Pairing external devices, such as neckband 205, with AR eyewear devices may enable the eyewear devices to achieve the form factor of a pair of glasses while still providing sufficient battery and computation power for expanded capabilities. Some or all of the battery power, computational resources, and/or additional features of AR system 200 may be provided by a paired device or shared between a paired device and an eyewear device, thus reducing the weight, heat profile, and form factor of the eyewear device overall while still retaining desired functionality. For example, neckband 205 may allow components that would otherwise be included on an eyewear device to be included in neckband 205 since users may tolerate a heavier weight load on their shoulders than they would tolerate on their heads. Neckband 205 may also have a larger surface area over which to diffuse and disperse heat to the ambient environment. Thus, neckband 205 may allow for greater battery and computation capacity than might otherwise have been possible on a stand-alone eyewear device. Since weight carried in neckband 205 may be less invasive to a user than weight carried in eyewear device 202, a user may tolerate wearing a lighter eyewear device and carrying or wearing the paired device for greater lengths of time than the user would tolerate wearing a heavy standalone eyewear device, thereby enabling an artificial reality environment to be incorporated more fully into a user's day-to-day activities.

Neckband 205 may be communicatively coupled with eyewear device 202 and/or to other devices. The other devices may provide certain functions (e.g., tracking, localizing, depth mapping, processing, storage, etc.) to the AR system 200. In the embodiment of FIG. 2, neckband 205 may include two acoustic sensors (e.g., 220(I) and 220(J)) that are part of the microphone array (or potentially form their own microphone subarray). Neckband 205 may also include a controller 225 and a power source 235.

Acoustic sensors 220(I) and 220(J) of neckband 205 may be configured to detect sound and convert the detected sound into an electronic format (analog or digital). In the embodiment of FIG. 2, acoustic sensors 220(I) and 220(J) may be positioned on neckband 205, thereby increasing the distance between the neckband acoustic sensors 220(I) and 220(J) and other acoustic sensors 220 positioned on eyewear device 202. In some cases, increasing the distance between acoustic sensors 220 of the microphone array may improve the accuracy of beamforming performed via the microphone array. For example, if a sound is detected by acoustic sensors 220(C) and 220(D) and the distance between acoustic sensors 220(C) and 220(D) is greater than, e.g., the distance between acoustic sensors 220(D) and 220(E), the determined source location of the detected sound may be more accurate than if the sound had been detected by acoustic sensors 220(D) and 220(E).

Controller 225 of neckband 205 may process information generated by the sensors on neckband 205 and/or AR system 200. For example, controller 225 may process information from the microphone array that describes sounds detected by the microphone array. For each detected sound, controller 225 may perform a DoA estimation to estimate a direction from which the detected sound arrived at the microphone array. As the microphone array detects sounds, controller 225 may populate an audio data set with the information. In embodiments in which AR system 200 includes an inertial measurement unit, controller 225 may compute all inertial and spatial calculations from the IMU located on eyewear device 202. Connector 230 may convey information between AR system 200 and neckband 205 and between AR system 200 and controller 225. The information may be in the form of optical data, electrical data, wireless data, or any other transmittable data form. Moving the processing of information generated by AR system 200 to neckband 205 may reduce weight and heat in eyewear device 202, making it more comfortable to the user.

Power source 235 in neckband 205 may provide power to eyewear device 202 and/or to neckband 205. Power source 235 may include, without limitation, lithium ion batteries, lithium-polymer batteries, primary lithium batteries, alkaline batteries, or any other form of power storage. In some cases, power source 235 may be a wired power source. Including power source 235 on neckband 205 instead of on eyewear device 202 may help better distribute the weight and heat generated by power source 235.

As noted, some artificial reality systems may, instead of blending an artificial reality with actual reality, substantially replace one or more of a user's sensory perceptions of the real world with a virtual experience. One example of this type of system is a head-worn display system, such as VR system 300 in FIG. 3, that mostly or completely covers a user's field of view. VR system 300 may include a front rigid body 302 and a band 304 shaped to fit around a user's head. VR system 300 may also include output audio transducers 306(A) and 306(B). Furthermore, while not shown in FIG. 3, front rigid body 302 may include one or more electronic elements, including one or more electronic displays, one or more inertial measurement units (IMUS), one or more tracking emitters or detectors, and/or any other suitable device or system for creating an artificial reality experience.

Artificial reality systems may include a variety of types of visual feedback mechanisms. For example, display devices in AR system 200 and/or VR system 300 may include one or more liquid crystal displays (LCDs), light emitting diode (LED) displays, organic LED (OLED) displays, and/or any other suitable type of display screen. Artificial reality systems may include a single display screen for both eyes or may provide a display screen for each eye, which may allow for additional flexibility for varifocal adjustments or for correcting a user's refractive error. Some artificial reality systems may also include optical subsystems having one or more lenses (e.g., conventional concave or convex lenses, Fresnel lenses, adjustable liquid lenses, etc.) through which a user may view a display screen.

In addition to or instead of using display screens, some artificial reality systems may include one or more projection systems. For example, display devices in AR system 200 and/or VR system 300 may include micro-LED projectors that project light (using, e.g., a waveguide) into display devices, such as clear combiner lenses that allow ambient light to pass through. The display devices may refract the projected light toward a user's pupil and may enable a user to simultaneously view both artificial reality content and the real world. Artificial reality systems may also be configured with any other suitable type or form of image projection system.

Artificial reality systems may also include various types of computer vision components and subsystems. For example, AR system 100, AR system 200, and/or VR system 300 may include one or more optical sensors such as two-dimensional (2D) or three-dimensional (3D) cameras, time-of-flight depth sensors, single-beam or sweeping laser rangefinders, 3D LiDAR sensors, and/or any other suitable type or form of optical sensor. An artificial reality system may process data from one or more of these sensors to identify a location of a user, to map the real world, to provide a user with context about real-world surroundings, and/or to perform a variety of other functions.

Artificial reality systems may also include one or more input and/or output audio transducers. In the examples shown in FIGS. 1 and 3, output audio transducers 108(A), 108(B), 306(A), and 306(B) may include voice coil speakers, ribbon speakers, electrostatic speakers, piezoelectric speakers, bone conduction transducers, cartilage conduction transducers, and/or any other suitable type or form of audio transducer. Similarly, input audio transducers 110 may include condenser microphones, dynamic microphones, ribbon microphones, and/or any other type or form of input transducer. In some embodiments, a single transducer may be used for both audio input and audio output.

Figure 3:
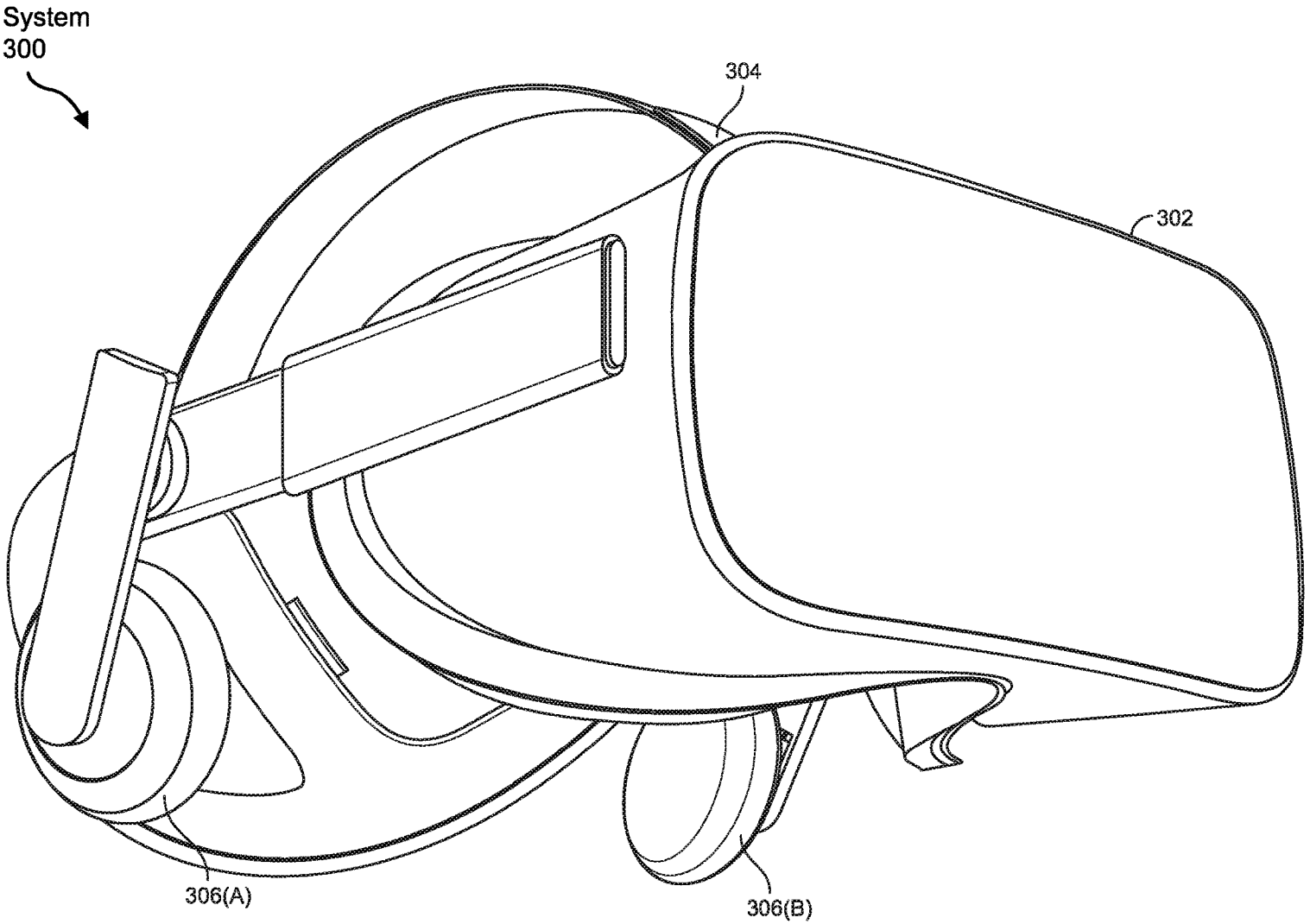
FIG. 3 illustrates an embodiment of a virtual reality headset.

While not shown in FIGS. 1-3, artificial reality systems may include tactile (i.e., haptic) feedback systems, which may be incorporated into headwear, gloves, body suits, handheld controllers, environmental devices (e.g., chairs, floormats, etc.), and/or any other type of device or system. Haptic feedback systems may provide various types of cutaneous feedback, including vibration, force, traction, texture, and/or temperature. Haptic feedback systems may also provide various types of kinesthetic feedback, such as motion and compliance. Haptic feedback may be implemented using motors, piezoelectric actuators, fluidic systems, and/or a variety of other types of feedback mechanisms. Haptic feedback systems may be implemented independent of other artificial reality devices, within other artificial reality devices, and/or in conjunction with other artificial reality devices.

By providing haptic sensations, audible content, and/or visual content, artificial reality systems may create an entire virtual experience or enhance a user's real-world experience in a variety of contexts and environments. For instance, artificial reality systems may assist or extend a user's perception, memory, or cognition within a particular environment. Some systems may enhance a user's interactions with other people in the real world or may enable more immersive interactions with other people in a virtual world. Artificial reality systems may also be used for educational purposes (e.g., for teaching or training in schools, hospitals, government organizations, military organizations, business enterprises, etc.), entertainment purposes (e.g., for playing video games, listening to music, watching video content, etc.), and/or for accessibility purposes (e.g., as hearing aids, visuals aids, etc.). The embodiments disclosed herein may enable or enhance a user's artificial reality experience in one or more of these contexts and environments and/or in other contexts and environments.

Some AR systems may map a user's environment using techniques referred to as "simultaneous location and mapping" (SLAM). SLAM mapping and location identifying techniques may involve a variety of hardware and software tools that can create or update a map of an environment while simultaneously keeping track of a user's location within the mapped environment. SLAM may use many different types of sensors to create a map and determine a user's position within the map.

SLAM techniques may, for example, implement optical sensors to determine a user's location. Radios including WiFi, Bluetooth, global positioning system (GPS), cellular or other communication devices may be also used to determine a user's location relative to a radio transceiver or group of transceivers (e.g., a WiFi router or group of GPS satellites). Acoustic sensors such as microphone arrays or 2D or 3D sonar sensors may also be used to determine a user's location within an environment. AR and VR devices (such as systems 100, 200, and 300 of FIGS. 1 and 2, respectively) may incorporate any or all of these types of sensors to perform SLAM operations such as creating and continually updating maps of the user's current environment. In at least some of the embodiments described herein, SLAM data generated by these sensors may be referred to as "environmental data" and may indicate a user's current environment. This data may be stored in a local or remote data store (e.g., a cloud data store) and may be provided to a user's AR/VR device on demand.

When the user is wearing an AR headset or VR headset in a given environment, the user may be interacting with other users or other electronic devices that serve as audio sources. In some cases, it may be desirable to determine where the audio sources are located relative to the user and then present the audio sources to the user as if they were coming from the location of the audio source. The process of determining where the audio sources are located relative to the user may be referred to herein as "localization," and the process of rendering playback of the audio source signal to appear as if it is coming from a specific direction may be referred to herein as "spatialization."

Localizing an audio source may be performed in a variety of different ways. In some cases, an AR or VR headset may initiate a direction of arrival (DOA) analysis to determine the location of a sound source. The DOA analysis may include analyzing the intensity, spectra, and/or arrival time of each sound at the AR/VR device to determine the direction from which the sounds originated. In some cases, the DOA analysis may include any suitable algorithm for analyzing the surrounding acoustic environment in which the artificial reality device is located.

For example, the DOA analysis may be designed to receive input signals from a microphone and apply digital signal processing algorithms to the input signals to estimate the direction of arrival. These algorithms may include, for example, delay and sum algorithms where the input signal is sampled, and the resulting weighted and delayed versions of the sampled signal are averaged together to determine a direction of arrival. A least mean squared (LMS) algorithm may also be implemented to create an adaptive filter. This adaptive filter may then be used to identify differences in signal intensity, for example, or differences in time of arrival. These differences may then be used to estimate the direction of arrival. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct-path audio signal. Those bins having a portion of the direct-path signal may then be analyzed to identify the angle at which a microphone array received the direct-path audio signal. The determined angle may then be used to identify the direction of arrival for the received input signal. Other algorithms not listed above may also be used alone or in combination with the above algorithms to determine DOA.

In some embodiments, different users may perceive the source of a sound as coming from slightly different locations. This may be the result of each user having a unique head-related transfer function (HRTF), which may be dictated by a user's anatomy including ear canal length and the positioning of the ear drum. The artificial reality device may provide an alignment and orientation guide, which the user may follow to customize the sound signal presented to the user based on their unique HRTF. In some embodiments, an artificial reality device may implement one or more microphones to listen to sounds within the user's environment. The AR or VR headset may use a variety of different array transfer functions (e.g., any of the DOA algorithms identified above) to estimate the direction of arrival for the sounds. Once the direction of arrival has been determined, the artificial reality device may play back sounds to the user according to the user's unique HRTF. Accordingly, the DOA estimation generated using the array transfer function (ATF) may be used to determine the direction from which the sounds are to be played from. The playback sounds may be further refined based on how that specific user hears sounds according to the HRTF.

In addition to or as an alternative to performing a DOA estimation, an artificial reality device may perform localization based on information received from other types of sensors. These sensors may include cameras, IR sensors, heat sensors, motion sensors, GPS receivers, or in some cases, sensor that detect a user's eye movements. For example, as noted above, an artificial reality device may include an eye tracker or gaze detector that determines where the user is looking. Often, the user's eyes will look at the source of the sound, if only briefly. Such clues provided by the user's eyes may further aid in determining the location of a sound source. Other sensors such as cameras, heat sensors, and IR sensors may also indicate the location of a user, the location of an electronic device, or the location of another sound source. Any or all of the above methods may be used individually or in combination to determine the location of a sound source and may further be used to update the location of a sound source over time.

Some embodiments may implement the determined DOA to generate a more customized output audio signal for the user. For instance, an "acoustic transfer function" may characterize or define how a sound is received from a given location. More specifically, an acoustic transfer function may define the relationship between parameters of a sound at its source location and the parameters by which the sound signal is detected (e.g., detected by a microphone array or detected by a user's ear). An artificial reality device may include one or more acoustic sensors that detect sounds within range of the device. A controller of the artificial reality device may estimate a DOA for the detected sounds (using, e.g., any of the methods identified above) and, based on the parameters of the detected sounds, may generate an acoustic transfer function that is specific to the location of the device. This customized acoustic transfer function may thus be used to generate a spatialized output audio signal where the sound is perceived as coming from a specific location.

Indeed, once the location of the sound source or sources is known, the artificial reality device may re-render (i.e., spatialize) the sound signals to sound as if coming from the direction of that sound source. The artificial reality device may apply filters or other digital signal processing that alter the intensity, spectra, or arrival time of the sound signal. The digital signal processing may be applied in such a way that the sound signal is perceived as originating from the determined location. The artificial reality device may amplify or subdue certain frequencies or change the time that the signal arrives at each ear. In some cases, the artificial reality device may create an acoustic transfer function that is specific to the location of the device and the detected direction of arrival of the sound signal. In some embodiments, the artificial reality device may re-render the source signal in a stereo device or multi-speaker device (e.g., a surround sound device). In such cases, separate and distinct audio signals may be sent to each speaker. Each of these audio signals may be altered according to the user's HRTF and according to measurements of the user's location and the location of the sound source to sound as if they are coming from the determined location of the sound source. Accordingly, in this manner, the artificial reality device (or speakers associated with the device) may re-render an audio signal to sound as if originating from a specific location.

Figure 4:
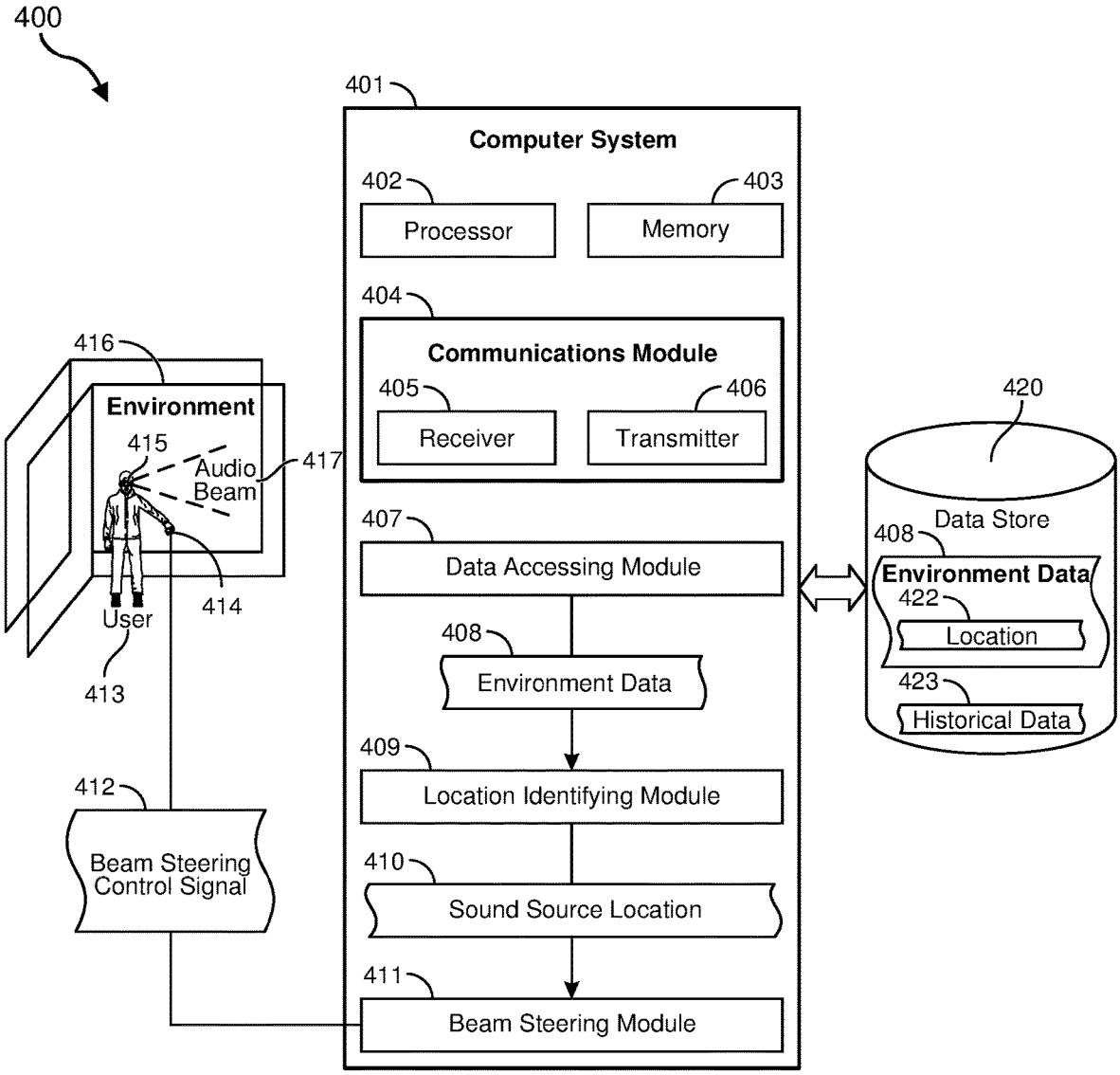
FIG. 4 illustrates an embodiment in which the embodiments described herein may be performed including directionally beamforming based on environment data.

FIG. 4 illustrates a computing architecture 400 in which many of the embodiments described herein may operate. The computing architecture 400 may include a computer system 401. The computer system 401 may include at least one processor 402 and at least some system memory 403. The computer system 401 may be any type of local or distributed computer system, including a cloud computer system. The computer system 401 may include program modules for performing a variety of different functions. The program modules may be hardware-based, software-based, or may include a combination of hardware and software. Each program module may use or represent computing hardware and/or software to perform specified functions, including those described herein below.

For example, communications module 404 may be configured to communicate with other computer systems. The communications module 404 may include any wired or wireless communication means that can receive and/or transmit data to or from other computer systems. These communication means may include radios including, for example, a hardware-based receiver 405, a hardware-based transmitter 406, or a combined hardware-based transceiver capable of both receiving and transmitting data. The radios may be WIFI radios, cellular radios, Bluetooth radios, global positioning system (GPS) radios, or other types of radios. The communications module 404 may be configured to interact with databases, mobile computing devices (such as mobile phones or tablets), embedded systems, or other types of computing systems.

The computer system of FIG. 4 may further include a data accessing module 407. The data accessing module 407 may access environmental data 408 in data store 420, for example. The environmental data 421 may include information regarding user 413's current environment 416 including sound sources present in that environment. For instance, the user 413 may be in a room or building. The environment data 408 may include information for that location 422. The information may include room size information, type of flooring, type of wall decorations, height of ceiling, position of windows, or other information that might affect acoustics within the room. The environment data 408 may also include location of chairs, benches, tables, or other furniture or other objects which the user would need to move around within the environment. Such knowledge may be useful when determining where a user is likely to move from their current position. This environmental data may be continually updated as changes are made to the environment or as people come and go from the environment 416.

The environment data 408 may be acquired in a variety of ways. For example, a 3D mapping device may be used to map a specific location. The 3D mapping device may include multiple different cameras and sensors mounted to a mobile chassis. This 3D mapping device may be carried around a room on the mobile chassis and may record and map many different characteristics of the room. These room characteristics may be fed to the user's AR headset where they are implemented to create a map of the user's current surroundings. The room characteristics may also be stored in the data store 420. The 3D mapping device may also include microphones to capture ambient sounds from the environment.

Additionally or alternatively, the environment data 408 may be acquired via an artificial reality headset mounted to a user's head. The AR headset (e.g., 100, 200 or 300 of FIG. 1, 2 or 3, respectively) may include a mapping subsystem that maps the local environment of the user when the wearable frame is secured to the user's head. The mapping subsystem may include the following: a projector that projects structured light into the local environment, an array of depth cameras that captures reflections of the structured light from the local environment, a localization device that determines the location of the head-mounted display system, and/or an array of photographic cameras that captures visible-spectrum light from the local environment. In such embodiments, the array of depth cameras may capture reflections of the structured light to detect a distance between each depth camera and a reflection of the structured light. Additionally, in these embodiments, a localization device may include a localization camera that captures image data for determining a relative position of the head-mounted display system within the local environment and may also include a localization sensor that identifies movement of the head-mounted display system within the local environment.

Still further, the environment data 408 may be generated by an AR headset which includes a machine-perception subsystem that is coupled to the AR headset and that gathers information about the local environment by observing the local environment. The AR headset may include a non-visual communication subsystem that outputs the contextual information about the user's local environment. The machine-perception subsystem may include an audio localization subsystem that has input transducers attached to the AR headset that enable directional detection of a sound within the local environment. The audio localization subsystem may have a processor programmed to compare output signals received from the input transducers to identify a direction from which the sound in the local environment is received. The non-visual communication subsystem may also include an output transducer configured to generate sound waves that communicate the contextual information to the user.

In another embodiment, the environment data 408 may be provided by an imaging device including, without limitation, visible-light cameras, infrared cameras, thermal cameras, radar sensor, or other image sensors. The imaging device may take an image and send the image data to a hardware accelerator. The hardware accelerator may generate a multi-scale representation of the imaging data sent from the imaging device. Then, an image-based tracking subsystem may prepare a set of input data for a set of image-based tracking operations and direct the hardware accelerator unit to execute the set of image-based tracking operations using the generated multi-scale representation of the imaging data and the prepared set of input data. In this manner, the image-based tracking subsystem may track a user's location as the user moves through the environment. Environmental changes identified in the images may also be used to update the environment data 408.

The environment data 408 may be provided to the location identifying module 409 of computer system 401. The location identifying module 409 may identify a location of a sound source within the environment based on the accessed environment data. For example, within the environment 416, many different users may be present. Each may be standing alone or may be talking to someone. In cases where the environment is crowded, and a user is talking to someone, or is wanting to listen to someone, it may be difficult to hear that person. In some cases, that speaking user may be moving around or may be turning their head and, as such, might be difficult to hear. In some cases, the location identifying module 409 may determine a sound source's location (e.g., the speaking user's current location 422), and may determine, based on environment data 408, where the speaking user is likely to move within the environment 416. The determined location 410 may then be provided to the beam steering module 411.

The beam steering module 411 may be configured to electronically and/or mechanically steer audio beam 417 toward the identified location 410 of the sound source within the environment. Beam steering on the receiving end may allow a microphone or other signal receiver on the user's AR headset 415 or electronic device 414 to focus on audio signals from a given direction. This focusing allows other signals outside of the beam to be ignored or reduced in strength and allows the audio signals within the beam 417 to be amplified. As such, the listening user 413 may be able to clearly hear speaking users regardless of where they move within the environment 416. These and other embodiments will be described in greater detail below with regard to method 500 of FIG. 5 and with further regard to FIGS. 5-8.

Figure 5:
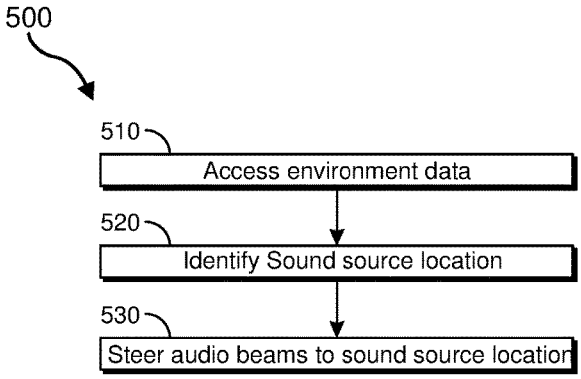
FIG. 5 illustrates a flow diagram of an exemplary method for directionally beamforming based on environment data.

FIG. 5 is a flow diagram of an exemplary computer-implemented method 500 for directionally beamforming based on an anticipated location. The steps shown in FIG. 5 may be performed by any suitable computer-executable code and/or computing system, including the system(s) illustrated in FIG. 5. In one example, each of the steps shown in FIG. 5 may represent an algorithm whose structure includes and/or is represented by multiple sub-steps, examples of which will be provided in greater detail below.

As illustrated in FIG. 5, at step 510, the systems described herein may access various portions of environment data indicating a current location of a device or sound source within an environment. The device may include one or more audio hardware components configured to generate steerable audio beams. For example, the data accessing module 407 may access environment data 408 from data store 420. The environment data 408 may include information about a given environment (e.g., 416), including whether the environment is outdoors or indoors, whether the environment is enclosed or open, the size of the environment, whether obstacles exist within the environment, etc. Other environment data 408 may include acoustic data for the environment, the number and/or location of sound sources such as speakers, televisions, or other electric devices, data indicating the number of persons within the environment, and perhaps the locations 422 of these persons. In some embodiments, the people within an environment may have a mobile device 414 such as a phone, tablet, laptop, smart watch, or other electronic device.

Additionally or alternatively, the people may have AR or VR headsets 415 (which may be similar to or the same as headsets 100, 200 or 300 of FIG. 1, 2 or 3, respectively). These headsets may include radios (e.g., WiFi, Bluetooth, cellular, or global positioning system (GPS) radios) that communicate their position within the environment. All of this location information 422 for each AR headset (and correspondingly, for each user) may be stored in data store 420 and may be continually updated as the people move within the environment 416. Accordingly, the location data 422 may include current and past locations for any or all of the users in the environment 416.

The environment data 408 may be used by the computer system 401 to determine where users are, who they are conversing with, and how to best assist those users in hearing each other. The computer system may use the location information, acoustic information, and other environment data to determine the best direction to steer an audio beam (e.g., 417). By steering the audio beam in the optimal direction, the user will have the best chance of hearing the person with whom they are conversing. Alternatively, if the user is watching a movie or paying attention to another sound source, steering the beam in the direction of the sound source may assist the user 413 in hearing the audio source. As will be explained further below, electronically or mechanically focusing a microphone on a person who is speaking may greatly increase the microphone's ability to detect the user's speech. Additional electronic processing may be performed to refine the focus of the audio beam 417 to point squarely at the person who is speaking (or at another source of sound), thereby increasing the audibility of the user's words.

Method 500 of FIG. 5 next includes identifying the location of the sound source within the environment based on the accessed environment data (step 520). In the embodiments herein, "the sound source" or "the device" may refer to an AR/VR headset 415 or a mobile device 414 (e.g., a smartphone, tablet, laptop, wearable device, etc.), or both. Such devices are typically held or worn by users and, as such, locating the device typically also locates the associated user. The location identifying module 409 may thus identify, using the environment data 408, where certain sound sources (e.g., users or user devices) are currently positioned, which locations each user has previously been to, and which locations the user will likely move next based on where their corresponding AR headset 415 or device 414 has been. The new future location 410 may be close to where the user is currently (e.g., only a few inches away), or may be far away from where the user is currently. Future device/user locations 410 may be continually recalculated to ensure that the user's devices are performing beamforming in the optimal direction.

Method 500 also includes steering the one or more audio beams of the device to the identified location of the sound source within the environment (step 530). The beam steering module 411 may use the calculated future device or sound source location 410 to steer audio beam 417 to the location where the user is now or where the user is anticipated to move. The beam steering module 411 may control a microphone directly or may transmit beam steering control signals 412 to a device to control the beam steering. Indeed, it will be understood that in the embodiments herein, the computer system 401 may be part of or may be built into the user's AR headset 415. Alternatively, the computer system 401 may be part of the user's electronic device 414. Still further, the computer system 401 may be remote to both the AR headset 415 and the user's electronic device 414 but may be in communication with either or both of these devices and may perform the calculations described herein. In such cases, the computer system 401 may be a cloud server or enterprise server reachable through a network. The modules of computer system 401 may be embedded within the AR headset 415, embedded within a mobile device 414 of the user, or may be part of a separate computing system that is in communication with devices 414 and/or 415.

In some of the embodiments herein, the user 413 may be wearing an AR headset (e.g., 415). Although VR or mixed reality (MR) headsets may also be used, AR headsets will chiefly be described herein for simplicity's sake. The user's AR headset 415 may include transparent lenses that allow the user to see out into the environment 416. The transparent lenses may also be at least partially reflective on the interior part of the lenses, so that a small projector built into the headset can project and reflect images into the user's eyes. These images may appear to the user alongside real-life objects. Accordingly, the environment 416 may be augmented to include digital objects visible to the user (and perhaps other users), along with any real-life objects such as doors, walls, chairs, tables or people. In addition to the partially reflective lenses, the AR headset 415 may include a microphone and/or speakers or ear buds. The speakers or ear buds reproduce audio signals for the user 413 to hear. The microphone allows the AR headset to detect external audio signals. Some of these external audio signals may be more important to the user than others and, as such, beamforming may be performed to focus in on those external sounds that are important to the user.

Figure 6:
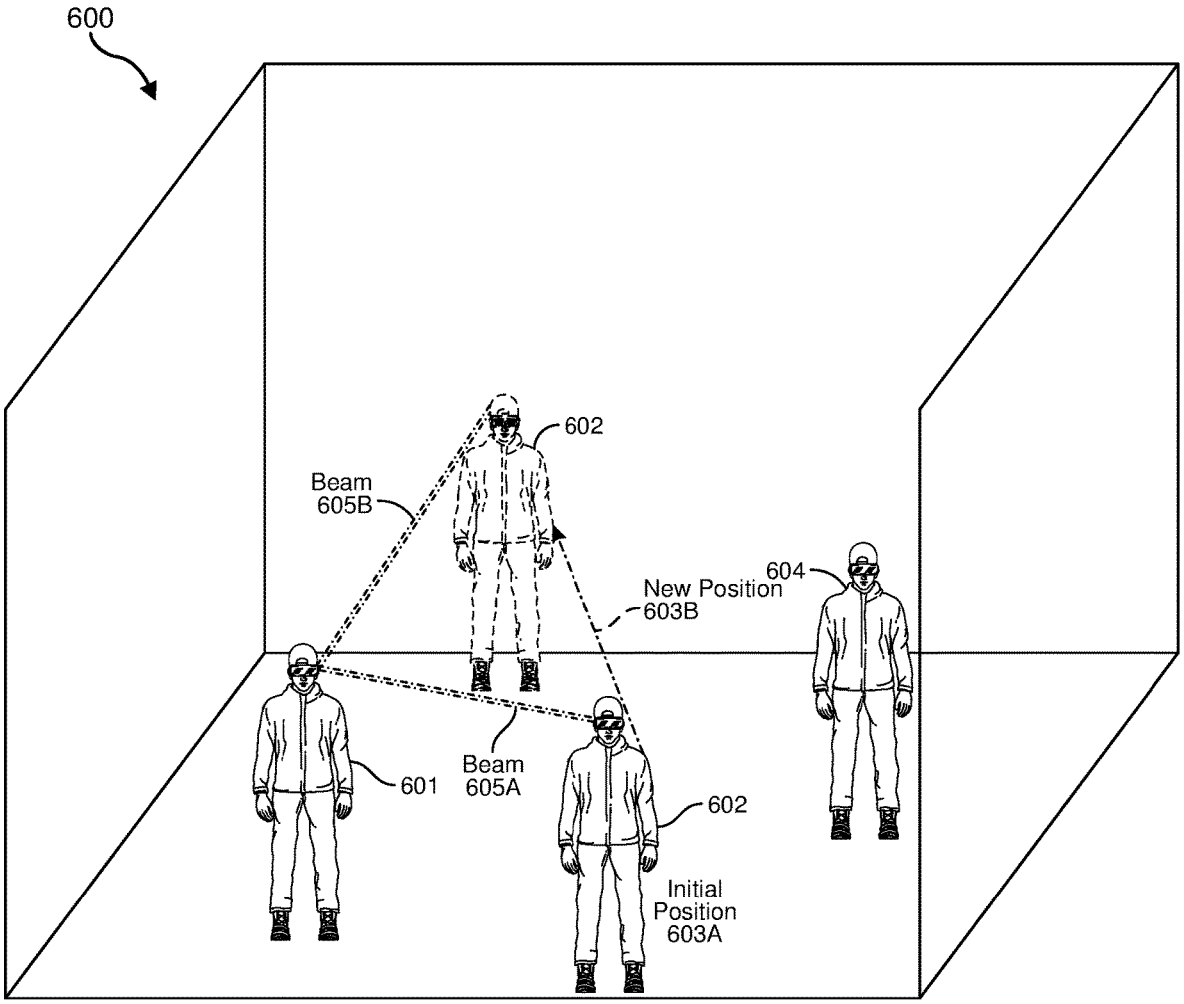
FIG. 6 illustrates an alternative embodiment in which then embodiments described herein may operate including directionally beamforming based on environment data.

FIG. 6 illustrates an embodiment in which an environment 600 includes multiple people. While the environment 600 is illustrated as an indoor room, it will be understood that the environment 600 may be substantially any type of environment, indoor or outdoor. Similarly, while the environment shows three people, it will be understood that substantially any number of people may be in the environment 600 at a given time. User 601 may be conversing with user 602. User 604 may be listening to user 602 as well or may be listening to something else. User 601 is illustrated as wearing an AR headset that has focused a beam 605A on user 602. If the user 602 decides to move from an initial position 603A to a new position 603B, user 601's AR headset may implement the environment data 608 of FIG. 6 to identify one or more likely locations where the user 602 will move.

The location identifying module 409 of FIG. 4, for example, may look at user 602's past locations within the environment 600, time spent at each location, and knowledge of items within the room such as food tables, restrooms, doors, chairs, or other items. Each such item may provide clues as to where the user 602 might go to sit down, get food, exit the room, or talk with another user. Upon determining that the user 602 is most likely to move to the new location 603B, the beam steering module 611 may steer the beam 605B toward the new location 603B. Then, when the user 602 moves to that position, the beam 605B is already steered in that direction.

The location identifying module 609 may also calculate multiple intermediate positions between the initial position 603A and the new position 603B. Accordingly, as the user moves between positions, the beam steering module 611 may continually adjust the direction of the beam 605B so that it is (constantly) tracking user 602's position. If the user 602 moves to a location that was not anticipated, the location identifying module 609 may again consult the environment data 608 to determine a new likely future location 610 and steer the beam in that direction.

In some embodiments, each AR device may be configured to record its own location and, in some cases, transmit that location to other AR devices, either directly or through an intermediate server. Additionally or alternatively, each AR device within the environment 600 may be configured to record the location of other AR devices (such as those worn by users 602 and 604) using sensor data captured by the AR devices (e.g., SLAM data). The sensor data may include Bluetooth or other wireless signals, infrared sensors, heat sensors, motion sensors, GPS trackers or other sensor data. Any or all of the sensor data and location data may also be passed to a local or remote server (e.g., a cloud server). Using this data, the server may continuously monitor the location of each user using their AR devices. The server may thus be aware of where each user currently is, and where each user has been previously. This historical movement data 623 may be implemented by the location identifying module 609 to learn users' movement patterns and determine where the user is most likely to move next.

Figure 7:
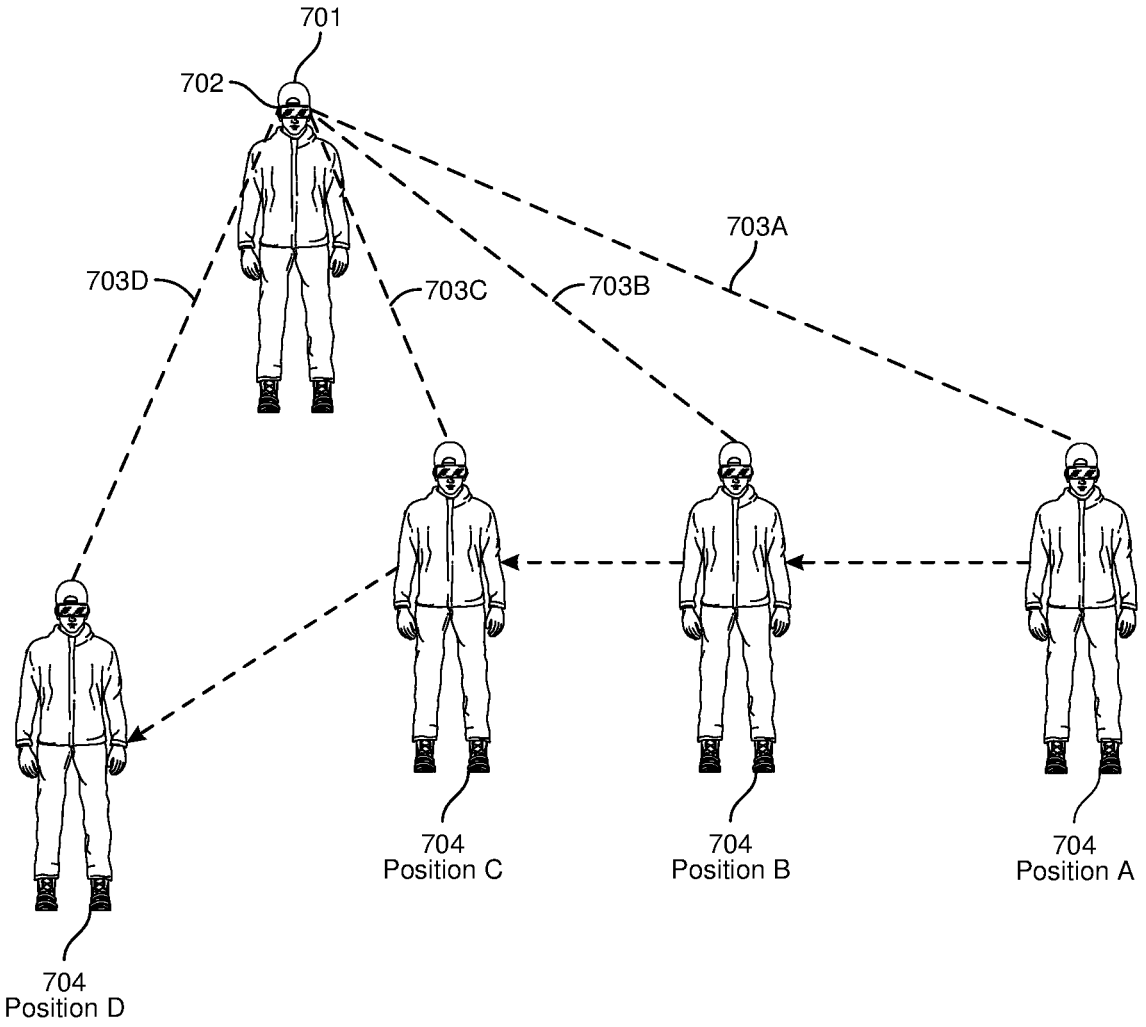
FIG. 7 illustrates an alternative embodiment in which then embodiments described herein may operate including directionally beamforming based on environment data.

In some cases, the beam steering module 411 of computer system 401 may be configured to generate multiple different beams. For instance, as shown in FIG. 7, user 701 may be wearing an AR headset 702 that forms an initial beam 703A directed toward user 704 at position A. Because the location identifying module 409 may be configured to determine future device/sound source locations 410 on a continually updated basis, the beam steering module 411 may steer one beam to one location and begin steering another beam to another location. Thus, multiple audio beams may be formed toward the moving user 704. Thus, in FIG. 7, while user 704 moves from position A to position B, to position C, and then to position D, the beam steering module 411 may form beam 703A at position A, beam 703B at position B, beam 703C at position C and beam 703D at position D. In some embodiments, each beam may be formed separately, while in other embodiments, certain beams may be formed simultaneously.

For instance, beams 703A and 703B may be formed simultaneously. Then, when the user 704 has reached a certain location, the beam steering module 411 may stop forming beam 703A and may start forming beam 703C. In such an example, beams 703B and 703C would be produced together simultaneously. As user 704 continues to move, beam 703D may also be produced simultaneously, or beams 703B and/or 703C may be stopped. In some cases, the number of simultaneously generated beams may depend on various factors including the speed of the user 704, the amount of battery power available in the AR headset 702, the amount of interference or noise in the environment, or other factors.

Figure 8:
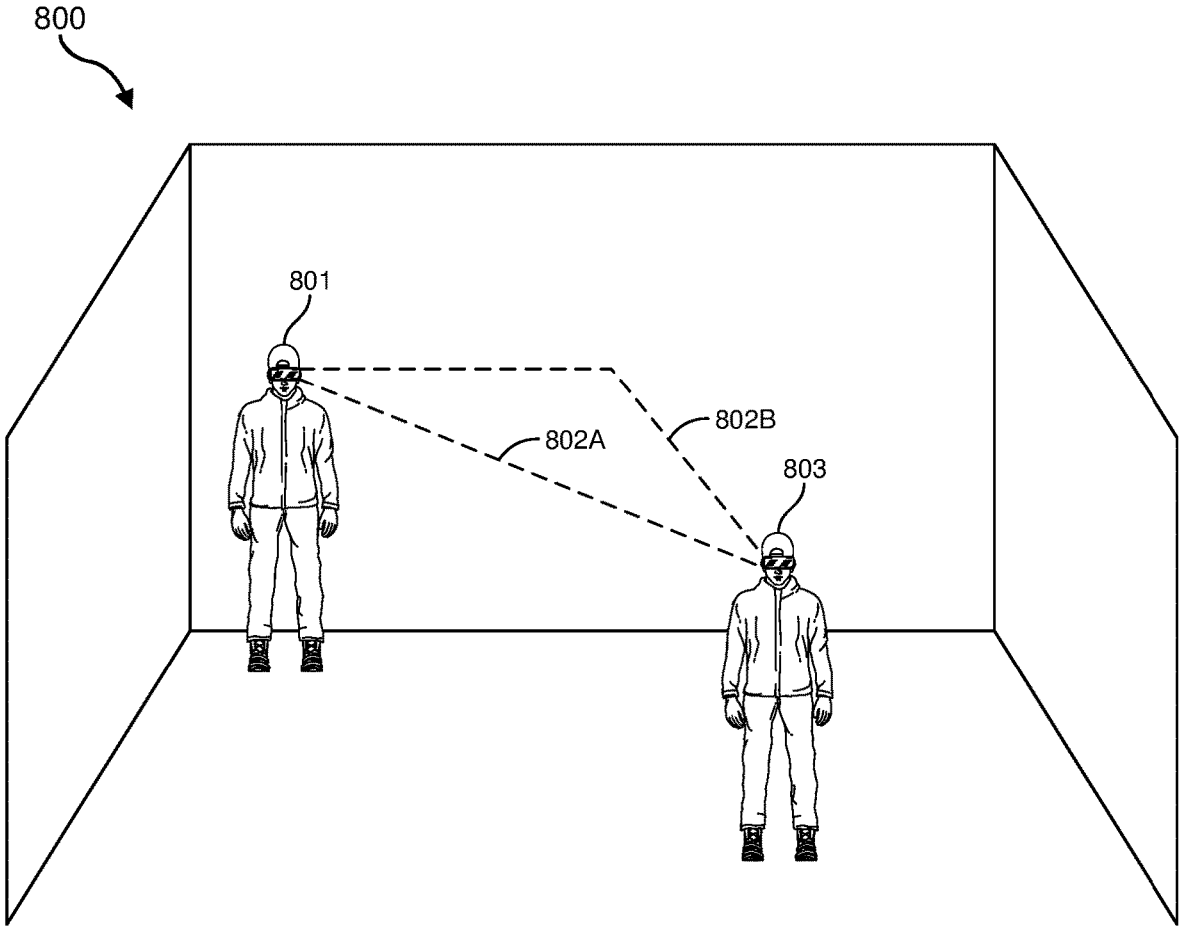
FIG. 8 illustrates an alternative embodiment in which then embodiments described herein may operate including directionally beamforming based on environment data.

FIG. 8 illustrates an embodiment in which the computer system 401 of FIG. 4 detects that a reverberated signal was received at the user's AR headset that is at a higher signal level than a direct-path signal. For example, in some environments, walls, floors or other reflective surfaces may reflect sound waves. In some cases, these reflected waves may be less attenuated (and thus stronger) than direct-path audio signals. In environment 800 of FIG. 8, for instance, a user 801 may be wearing an AR headset that receives two signals or two versions of the same signal. Version 802A is the direct-path signal, while version 802B is the reflected signal that has reflected off of a wall. User 801's AR headset (or computer system 401) may determine that the reflected signal 802B is stronger than the direct-path signal 802A. The beam steering module 411 may then steer the audio beams to travel along the path of the reflected or reverberated signal 802B. The determination of relative signal strength may be made using a direction-of-arrival (time-frequency) analysis, which identifies which signal is the strongest. Then, using this determination, the beam steering module 411 may steer the audio beam 417 toward the reflected signal 802 instead of toward the user 803.

If the user 803 of FIG. 8 moves at a later time to a new position, user 801's AR headset may determine that the signal strengths of signals 802A and 802B have changed. Based on this change, the location identifying module 409 may identify a new future location 410 for the user 803 and may cause the beam steering module 411 to transition the audio beam back to the direct-path signal 802A as the user moves to the new location.

In some embodiments, the beam steering module 411 of computer system 401 may generate beam steering control signals 412 that steer the audio beam 417 according to a specified beamforming policy. For instance, a beamforming policy may indicate that the audio beam 417 is to be steered to people that the user 413 has spoken with in the last 15 minutes. Alternatively, the policy may indicate that the audio beam 417 is to be steered to people that are friends or family of the user 413. In some embodiments, the environment data 408 or the user's AR headsets may identify the users wearing the headsets. The computer system 401 may also have access to user 413's contact list or various social media accounts on social media applications or platforms. Using this social media information, the beam steering module 411 may specifically target those users that are friends with user 413 on those social media platforms. Other policies may indicate that families, or members of the same team (in a game, for example), or members of another group may be given priority. As such, the beam steering module 411 may amplify sound signals from those users above the sound signals received from other users.

In some embodiments, the computer system 401 may be configured to access an audio signal that is to be reproduced using audio signals received via the audio beam. For example, in FIG. 4, the AR headset of user 401 may detect sounds coming from user 402 (e.g., speech). The AR headset may then identify the location of user 402's AR headset, and may modify the detected sounds to spatially re-render them as if coming from user 402. For example, if a given audio source is selected, the AR headset may re-render the audio signal from the audio source to spatially sound as if coming from the audio source's location. This re-rendering may implement customized head-related transfer function and DOA calculations as described above with regard to FIGS. 1-3. Accordingly, if a speaking user was speaking behind a listening user, the listening user would hear the speaking user's audio as if the speaking user was standing behind the user. This would be true even if the listening user was far enough away that they couldn't hear the speaker's actual voice. The reproduced version detected by the listening user's AR headset may be spatially rendered to sound as if coming from the direction of the sound source. Other processing may also be applied to the detected sound signals. For example, speech enhancement may be performed using filters and other digital signal processing algorithms. Such speech enhancement processing may, at least in some embodiments, result in a 12-15 dB increase in speech volume and may additionally assist in raising clarity.

Figure 9:
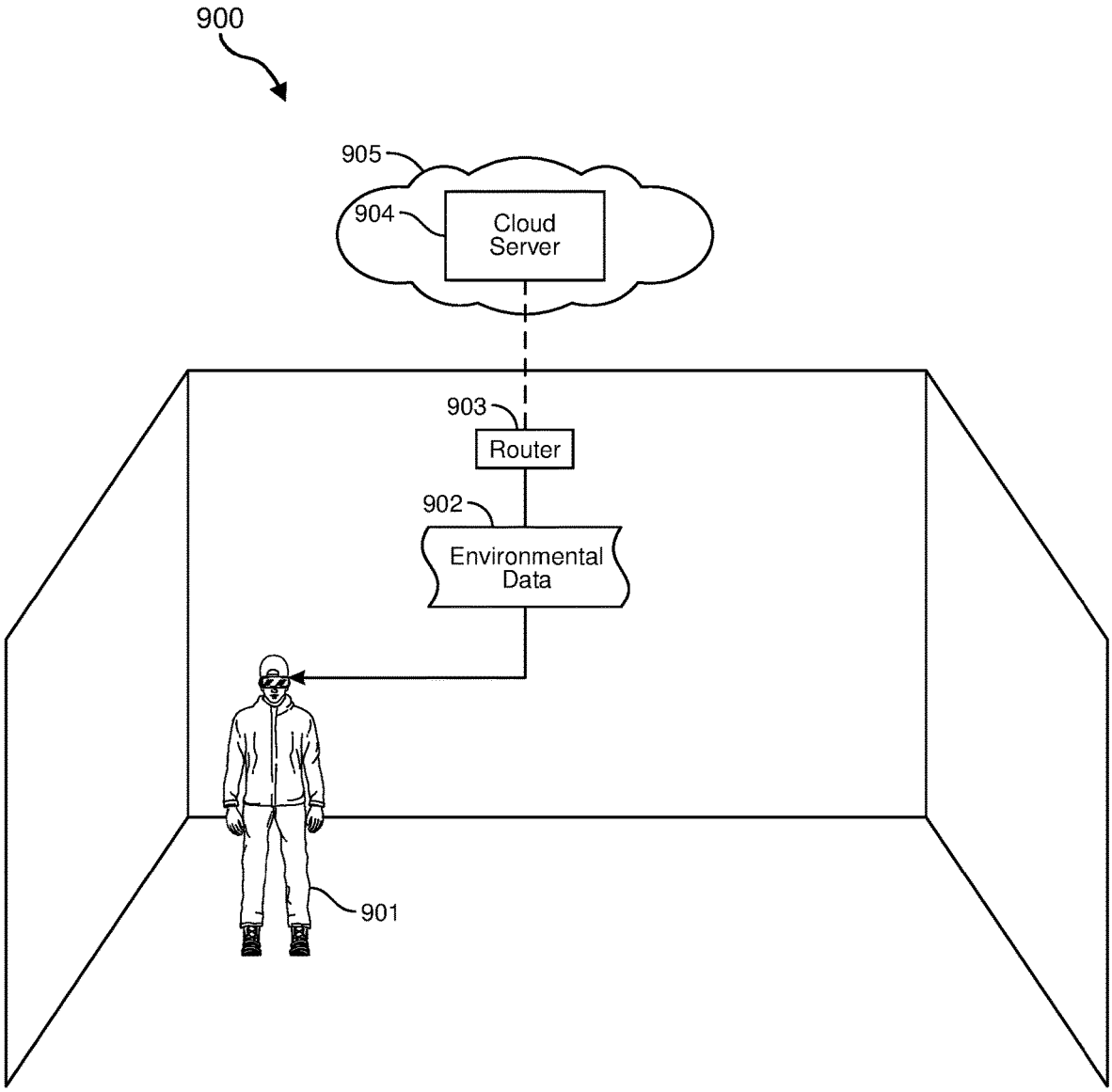
FIG. 9 illustrates an alternative embodiment in which then embodiments described herein may operate including directionally beamforming based on environment data.

The AR devices described herein may also be configured to receive pre-generated environment data and/or historical environmental data (e.g. 423 of FIG. 4) from a remote source and implement the received environment data or historical environmental data to identify the future device location. For instance, even if the AR device lacks the radios or sensors to determine its own location, the AR device may receive pre-generated environment data and/or historical environmental data and may use that data to identify where to beamform. For example, as shown in FIG. 9, user 901 may be using an AR device that receives environment data 902 from a cloud server 904. The user's AR headset may include a WiFi or Bluetooth radio that facilitates communication with a router 903 within the environment 900. The router 904 then provides access to the internet 905 and specifically to cloud server 904. The cloud server may generate and store environment data related to any environment, and may transmit to AR devices either directly, or through a router and/or firewall. Accordingly, even if an AR device lacks an ability to generate environment data using its own radios and sensors, it may receive such data from other sources and use it when determining where to beamform.

As shown in FIGS. 6-9, each environment may include a variable number of users. And, within that environment, one or more of the users may or may not have AR headsets or mobile devices. The embodiments herein are designed to take all the information available from AR or VR headsets, from mobile devices, from knowledge of buildings or outdoor venues, or other sources and use it to determine where the users are likely to move. User's devices may be continually providing new information about their movement patterns, about their environment, or about other users. The cloud server 904 of FIG. 9 may use any of all of this when computing current and/or future sound source or device locations. Similarly, any AR headset or mobile device may be capable of collecting its own data and sharing that data with others in the environment. Thus, some or all of the devices in a given environment may communicate with each other and with backend servers to create a databased of environment and locational knowledge that can be used to determine a user's most likely movements. These determined movements can then be used to beamform in an anticipatory manner, thereby providing listening users with a maximum level of signal quality and clarity.

In some cases, the cloud server 904 may augment the environment information 902 to account for delay and constraints of a target device. For example, the server 904 may add reverb for a sound that is supposed to be from the room and may push that reverb to the user's AR headset. Other signal processing including compression, speech enhancement, spatial re-rendering or other types of signal processing may also be performed by the server. For instance, the server 904 may combine a dry audio signal with one or more effects so that the modified dry audio signal sounds as if it originated in the environment. For example, a user may be speaking, and their voice may be recorded in a manner that results in a dry audio signal that lacks the characteristics of the listening user's current environment. In some cases, the server 904 may process the recorded voice signal, adding effects that make the voice signal sound as though it were recorded in the listening user's environment. Thus, even if the speaking user is speaking from a great distance away in a different environment, the audio processing may generate a sound signal that sounds as if it were recorded at the listening user's environment.

In some embodiments, the server 904 may be aware that a given user is hard of hearing or is at a concert where the background noise is very loud. As such, the server 904 may communicate with the user's AR headset, indicating that beamforming is needed to raise a signal level to a specified minimum level. Once that indication has been received, the AR device may generate steering control signals to raise the signal level to a specified minimum level. Other indications may also indicate that beamforming may not be needed, such as when background noise is low, or when the user is in their bedroom at home. Accordingly, beamforming may be based on the location of the user or according to user preferences or other circumstances such as ambient noise level.

Still further, in some embodiments, the environment data (e.g., 408) may be used to perform selective active noise cancellation in a specified direction. For instance, if a user wanted to hear one speaking user, but not another, the AR headset may apply active noise cancellation in the direction of the undesired speaking user and may beamform in the direction of the desired speaking user. Other environment data may be used to perform such directed active noise cancelling. For example, if the user is at a convention and background music is playing through a loudspeaker, the AR device may selectively direct active noise cancellation in the direction of the loudspeaker, and beamform in the direction of the person or people the user is conversing with. The environment data 408 may indicate the location of such loudspeakers, or air conditioners, honking cars or other unwanted sound sources. The AR headsets may be programmed to selectively remove sounds from a specified a direction, or to selectively allow sounds from a specified direction. The AR headsets may thus be programmed to detect a given sound signal and create a filter for that signal so that it can be removed through active noise cancellation.

In addition, a corresponding system for directionally beamforming based on an anticipated location may include several modules stored in memory, including a data accessing module configured to access environment data indicating a sound source within the environment. The device may include audio hardware components configured to generate steerable audio beams. The system may further include a location identifying module configured to identify the location of the sound source within the environment based on the accessed environment data. The system may also include a beam steering module configured to steer the audio beams of the device to the identified location of the sound source within the environment.

In some examples, the above-described method may be encoded as computer-readable instructions on a computer-readable medium. For example, a computer-readable medium may include one or more computer-executable instructions that, when executed by at least one processor of a computing device, may cause the computing device to access environment data indicating a sound source within the environment, identify the location of the sound source within the environment based on the accessed environment data, and steer the audio beams of the device to the identified location of the sound source within the environment.

Accordingly, the embodiments described herein provide environment data which allows AR headsets to determine where sound sources are within an environment and to beamform in the direction of the sound source. This allows AR headset users to move about themselves, listening and paying attention to different users, all while hearing each user clearly in their headsets. The embodiments herein may thus improve the user's experience with the AR headset, and make the headset easier to wear on a daily basis.

As detailed above, the computing devices and systems described and/or illustrated herein broadly represent any type or form of computing device or system capable of executing computer-readable instructions, such as those contained within the modules described herein. In their most basic configuration, these computing device(s) may each include at least one memory device and at least one physical processor.

In some examples, the term "memory device" generally refers to any type or form of volatile or non-volatile storage device or medium capable of storing data and/or computer-readable instructions. In one example, a memory device may store, load, and/or maintain one or more of the modules described herein. Examples of memory devices include, without limitation, Random Access Memory (RAM), Read Only Memory (ROM), flash memory, Hard Disk Drives (HDDs), Solid-State Drives (SSDs), optical disk drives, caches, variations or combinations of one or more of the same, or any other suitable storage memory.

In some examples, the term "physical processor" generally refers to any type or form of hardware-implemented processing unit capable of interpreting and/or executing computer-readable instructions. In one example, a physical processor may access and/or modify one or more modules stored in the above-described memory device. Examples of physical processors include, without limitation, microprocessors, microcontrollers, Central Processing Units (CPUs), Field-Programmable Gate Arrays (FPGAs) that implement softcore processors, Application-Specific Integrated Circuits (ASICs), portions of one or more of the same, variations or combinations of one or more of the same, or any other suitable physical processor.

Although illustrated as separate elements, the modules described and/or illustrated herein may represent portions of a single module or application. In addition, in certain embodiments one or more of these modules may represent one or more software applications or programs that, when executed by a computing device, may cause the computing device to perform one or more tasks. For example, one or more of the modules described and/or illustrated herein may represent modules stored and configured to run on one or more of the computing devices or systems described and/or illustrated herein. One or more of these modules may also represent all or portions of one or more special-purpose computers configured to perform one or more tasks.

In addition, one or more of the modules described herein may transform data, physical devices, and/or representations of physical devices from one form to another. For example, one or more of the modules recited herein may receive data to be transformed, transform the data, output a result of the transformation to perform a function, use the result of the transformation to perform a function, and store the result of the transformation to perform a function. Additionally or alternatively, one or more of the modules recited herein may transform a processor, volatile memory, non-volatile memory, and/or any other portion of a physical computing device from one form to another by executing on the computing device, storing data on the computing device, and/or otherwise interacting with the computing device.

In some embodiments, the term "computer-readable medium" generally refers to any form of device, carrier, or medium capable of storing or carrying computer-readable instructions. Examples of computer-readable media include, without limitation, transmission-type media, such as carrier waves, and non-transitory-type media, such as magnetic-storage media (e.g., hard disk drives, tape drives, and floppy disks), optical-storage media (e.g., Compact Disks (CDs), Digital Video Disks (DVDs), and BLU-RAY disks), electronic-storage media (e.g., solid-state drives and flash media), and other distribution systems.

Embodiments of the instant disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the instant disclosure. The embodiments disclosed herein should be considered in all respects illustrative and not restrictive. Reference should be made to the appended claims and their equivalents in determining the scope of the instant disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

We claim:

1. A computer-implemented method comprising:

providing a device;

accessing, at the device, one or more portions of environment data that includes an indication of at least one sound source within an environment, the device including one or more audio hardware components configured to generate one or more steerable audio beams;

generating a map of the environment using the accessed environment data;

identifying the location of the sound source on the map based on the accessed environment data; and steering the one or more steerable audio beams of the device to the identified location of the sound source on the map.

2. The computer-implemented method of claim 1, wherein the device comprises an artificial reality (AR) device and wherein the environment data comprises simultaneous location and mapping (SLAM) sensor data acquired by the AR device.

3. The computer-implemented method of claim 2, wherein the AR device comprises a pair of artificial reality glasses.

4. The computer-implemented method of claim 1, wherein the environment includes a plurality of AR devices, each AR device recording its own location.

5. The computer-implemented method of claim 1, wherein the environment includes a plurality of AR devices, each AR device recording the location of other AR devices using sensor data captured by the AR devices.

6. The computer-implemented method of claim 1, further comprising:

accessing one or more portions of historical device movement data; and implementing the accessed historical device movement data to identify a future sound source location where the sound source is likely to move.

7. The computer-implemented method of claim 1, further comprising determining future sound source locations on a continually updated basis, such that the one or more audio beams of the device are continually steered to the updated future sound source location.

8. The computer-implemented method of claim 1, further comprising:

detecting that a reverberated signal was received at the device at a higher signal level than a direct-path signal;

identifying at least one potential path traveled by the reverberated signal; and steering the one or more audio beams to travel along the identified path traveled by the reverberated signal.

9. The computer-implemented method of claim 8, further comprising transitioning the audio beam steering back to a direct path as the device moves between the current device location and the future device location.

10. The computer-implemented method of claim 1, wherein the generated map is updated using sensor data acquired at one or more sensors mounted on the device.

11. A device comprising:

at least one physical processor;

physical memory comprising computer-executable instructions that, when executed by the physical processor, cause the physical processor to:

access, at the device, one or more portions of environment data that includes an indication of at least one sound source within an environment, the device including one or more audio hardware components configured to generate one or more steerable audio beams;

generate a map of the environment using the accessed environment data;

identify the location of the sound source on the map based on the accessed environment data; and steer the one or more steerable audio beams of the device to the identified location of the sound source on the map.

12. The device of claim 11, further comprising:

accessing an audio signal that is to be reproduced using audio signals received via the one or more audio beams;

identifying the location of a second device; and modifying the accessed audio signal to spatially re-render the audio signal to sound as if coming from the second device.

13. The device of claim 11, further comprising receiving, at the device, pre-generated environment data or historical environmental data from a remote source and implementing the received pre-generated environment data or historical environmental data to identify a future sound source location.

14. The device of claim 11, further comprising providing, by one or more other devices in the environment, one or more portions of environment data to a server or to another local or remote device.

15. The device of claim 14, further comprising augmenting, by the server, the environment data to account for delay and constraints of a target device.

16. The device of claim 11, further comprising generating steering control signals upon determining that beamforming is needed to raise a signal level to a specified minimum level.

17. The device of claim 11, further comprising using the accessed portions of environment data to perform selective active noise cancellation in a specified direction.

18. The device of claim 17, further comprising adjusting one or more active noise cancellation parameters to selectively remove sounds from a specified a direction, or to selectively allow sounds from a specified direction.

19. The device of claim 11, further comprising combining a dry audio signal with one or more effects such that the combined dry audio signal sounds as if the combined dry audio signal originated in the environment.

20. A non-transitory computer-readable medium comprising one or more computer-executable instructions that, when executed by at least one processor of an artificial reality (AR) device, cause the AR device to:

access, at the AR device, one or more portions of environment data that includes an indication of at least one sound source within an environment, the AR device including one or more audio hardware components configured to generate one or more steerable audio beams;

generate a map of the environment using the accessed environment data;

identify the location of the sound source on the map based on the accessed environment data; and steer the one or more steerable audio beams of the AR device to the identified location of the sound source on the map.

* * * * *